United States Patent [19]

Rogers, Sr.

[11] 4,292,804

[45] Oct. 6, 1981

[54] METHOD AND APPARATUS FOR OPERATING AN ENGINE ON COMPRESSED GAS

[76] Inventor: Leroy K. Rogers, Sr., #5 Capistrano Ct., Ft. Myers, Fla. 33908

[21] Appl. No.: 158,303

[22] Filed: Jun. 10, 1980

[51] Int. Cl.[3] ..... F15B 11/06

[52] U.S. Cl. ..... 60/407; 91/187; 91/275

[58] Field of Search ..... 60/407, 412; 91/187, 91/275, 364

[56] References Cited

U.S. PATENT DOCUMENTS

| | | | |
|---|---|---|---|
| 3,881,399 | 5/1975 | Sagi et al. | 91/187 X |
| 3,885,387 | 5/1975 | Simington | 60/407 X |
| 4,018,050 | 4/1977 | Murphy | 60/412 X |

*Primary Examiner*—Allen M. Ostrager
*Attorney, Agent, or Firm*—Burns, Doane, Swecker & Mathis

[57] ABSTRACT

The present invention relates to a method and apparatus for operating an engine having a cylinder and a piston reciprocable therein on compressed gas. The apparatus comprises a source of compressed gas connected to a distributor which distributes the compressed gas to the cylinder. A valve is provided to selectively admit compressed gas to the cylinder when the piston is in an approximately top dead center position. In one embodiment of the present invention the timing of the opening of the valve is advanced such that the compressed gas is admitted to the cylinder progressively further before the top dead center position of the piston as the speed of the engine increases. In a further embodiment of the present invention a valve actuator is provided which increases the length of time over which the valve remains open to admit compressed gas to the cylinder as the speed of the engine increases. A still further embodiment of the present invention relates to an apparatus for adapting a conventional internal combustion engine for operation on compressed gas.

22 Claims, 8 Drawing Figures

Fig. 6
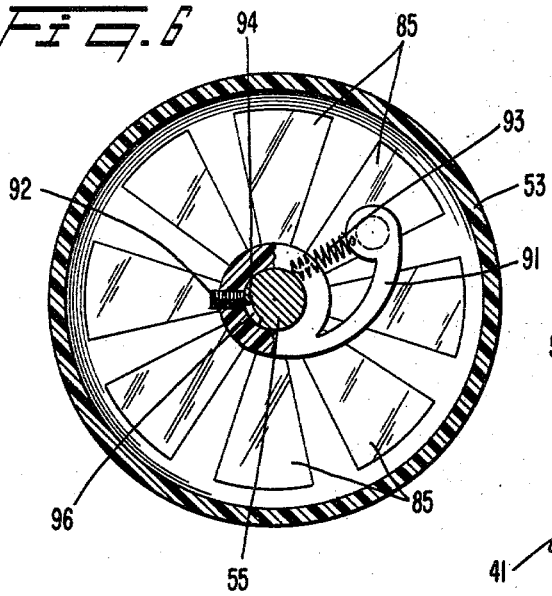
Fig. 7
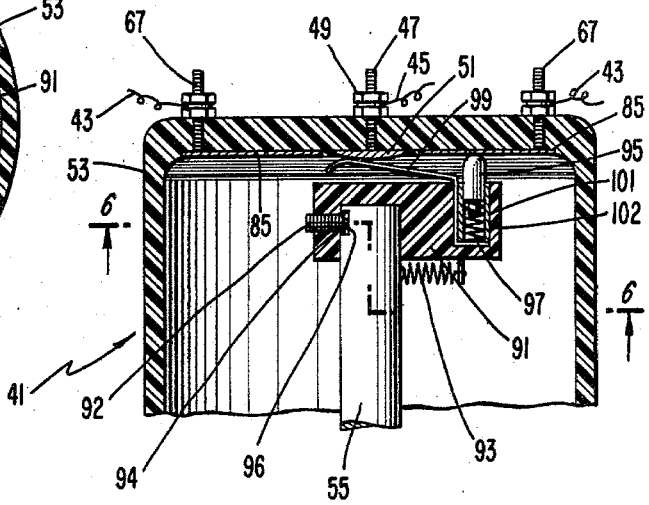
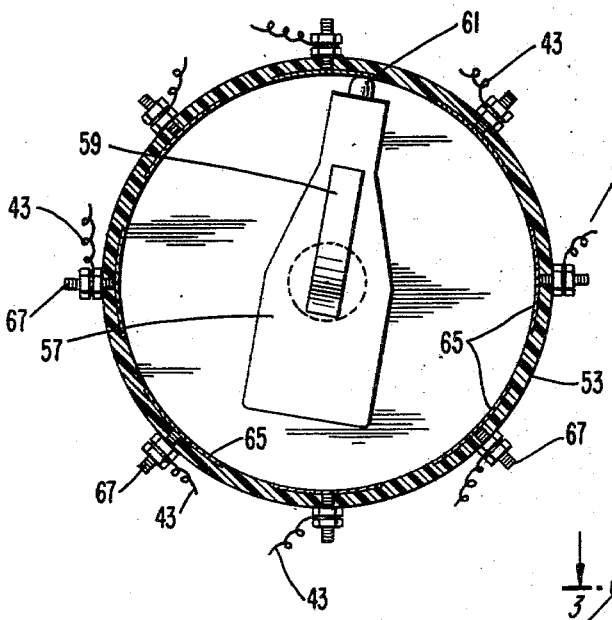
Fig. 3
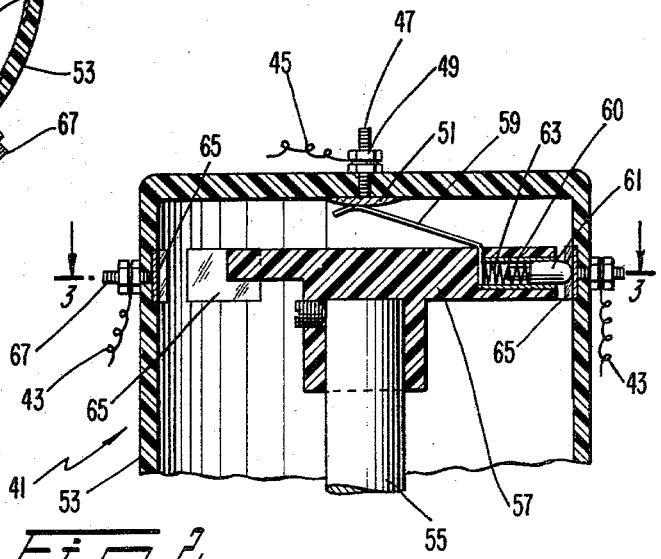
Fig. 2

METHOD AND APPARATUS FOR OPERATING AN ENGINE ON COMPRESSED GAS

BACKGROUND AND SUMMARY OF THE PRESENT INVENTION

The present invention relates to a method and apparatus for operating an engine using a compressed gas as the motive fluid. More particularly, the present invention relates to a apparatus for adapting a pre-existing internal combustion engine for operation on a compressed gas.

Air pollution is one of the most serious problems facing the world today. One of the major contributors to air pollution is ordinary internal combustion engine which are used in most motor vehicles today. Various devices, including many items mandated by legislation, have been proposed in an attempt to limit the pollutants which an internal combustion engine exhausts to the air. However, most of these devices have met with limited success and are often both prohibitively expensive and complex. A clean alternative to the internal combustion engine is needed to power vehicles and other machinery.

A compressed gas, preferably air, would provide an ideal motive fluid for a engine since it would eliminate the usual pollutants exhausted from an internal combustion engine. An apparatus for converting an internal combustion engine for operation on compressed air is disclosed in U.S. Pat. No. 3,885,387 issued May 27, 1975 to Simington. The Simington patent discloses an apparatus including a source of compressed air and a rotating valve actuator which opens and closes a plurality of mechanical poppet valves. The valves deliver compressed air in timed sequence to the cylinders of an engine through adapters located in the spark plug holes. However, the output speed of an engine of this type is limited by the speed of the mechanical valves and the fact that the length of time over which each of the valves remains open cannot be varied as the speed of the engine increases.

Another apparatus for converting an internal combustion engine for operation on steam or compressed air is disclosed in U.S. Pat. No. 4,102,130 issued July 25, 1978 to Stricklin. The Stricklin patent discloses a device which changes the valve timing of a conventional four stroke engine such that the intake and exhaust valves open once for every revolution of the engine instead of once every other revolution of the engine. A reversing valve is provided which delivers live steam or compressed air to the intake valves and is subsequently reversed to allow the exhaust valves to deliver the expanded steam or air to the atmosphere. A reversing valve of this type however does not provide a reliable apparatus for varying the amount of motive fluid injected into the cylinders when it is desired to increase the speed of the engine. Further, a device of the type disclosed in the Stricklin patent requires the use of multiple reversing valves if the cylinders in a multi-cylinder engine were to be fired sequentially.

Therefore, it is an object of the present invention to provide a reliable method and apparatus for operating an engine or converting an engine for operation with a compressed gas.

A further object of the present invention is to provide a method and apparatus which is effective to deliver a constantly increasing amount of compressed gas to an engine as the speed of the engine increases.

A still further object of the present invention is to provide a method and apparatus which will operate an engine using compressed gas at a speed sufficient to drive a conventional automobile at highway speeds.

It is still a further object of the present invention to provide a method and apparatus which is readily adaptable to a standard internal combustion engine to convert the internal combustion engine for operation with a compressed gas.

Another object of the invention is to provide a method and apparatus which utilizes cool expanded gas, exhausted from a compressed gas engine, to operate an air conditioning unit and/or an oil cooler.

These and other objects are realized by a method and apparatus according to the present invention for operating an engine having at least one cylinder and a reciprocating piston therein using compressed gas as a motive fluid. The apparatus includes a source of compressed gas and a distributor connected with the source of the compressed gas for distributing the compressed gas to the at least one cylinder. A valve is provided for admitting the compressed gas to the cylinder when the piston is in approximately a top dead center position within the cylinder. An exhaust is provided for exhausting the expanded gas from the cylinder as the piston returns to approximately the top dead center position.

In a preferred embodiment of the present invention a device is provided for varying the duration of each engine cycle over which the valve remains open to admit compressed gas to the cylinder dependent upon the speed of the engine. In a further preferred embodiment of the present invention, an apparatus for advancing the timing of the opening of the valve is arranged to admit the compressed gas to the cylinder progressively further before the top dead center position of the piston as the speed of the engine increases.

Further features of the present invention include a valve for controlling the amount of compressed gas admitted to the distributor. Also, a portion of the gas which has been expanded in the cylinder and exhausted through the exhaust valve is delivered to a compressor to be recompressed and returned to the source of compressed gas. A gear train is selectively engagable to drive the compressor at different operating speed depending upon the pressure maintained at the source of compressed air and/or the speed of the engine. Still further, a second portion of the exhaust gas is used to cool a lubricating fluid for the engine or to operate an air conditioning unit.

In a preferred embodiment of the present invention, the valve for admitting compressed gas to the cylinder is electrically actuated. The device for varying the duration of each engine cycle over which the intake valve remains open as the speed of the engine increase comprises a rotating element whose effective length increases as the speed of the engine increases such that a first contact on the rotating element is electrically connected to a second contact for a longer period of each engine cycle. The second contact actuates the valve whereby the valve remains in an open position for a longer period of each engine cycle as the speed of the engine increases.

Still further features of the present invention include an adaptor plate for supporting the distributor above an intake manifold of a conventional internal combustion engine after a carburetor has been removed to allow air to enter the cylinders of the engine through the intake manifold and conventional intake valves. Another adaptor plate is arranged over an exhaust passageway of the internal combustion engine to reduce the cross-sectional area of the exhaust passageway.

BRIEF DESCRIPTION OF THE DRAWINGS

Preferred embodiments of a method and apparatus for operating an engine according to the present invention will be described with reference to the accompanying drawings wherein like members bear like reference numerals and wherein:

FIG. 2 is a side view of one embodiment of a valve actuator according to the present invention;

FIG. 3 is a cross-sectional view taken along the line 3—3 in FIG. 2;

FIG. 6 is a cross-sectional view of a third embodiment of a valve actuator according to the present invention;

FIG. 7 is a view taken along the line 7—7 in FIG. 6;

DETAILED DESCRIPTION OF THE PREFERRED EMBODIMENTS

Figure 1:
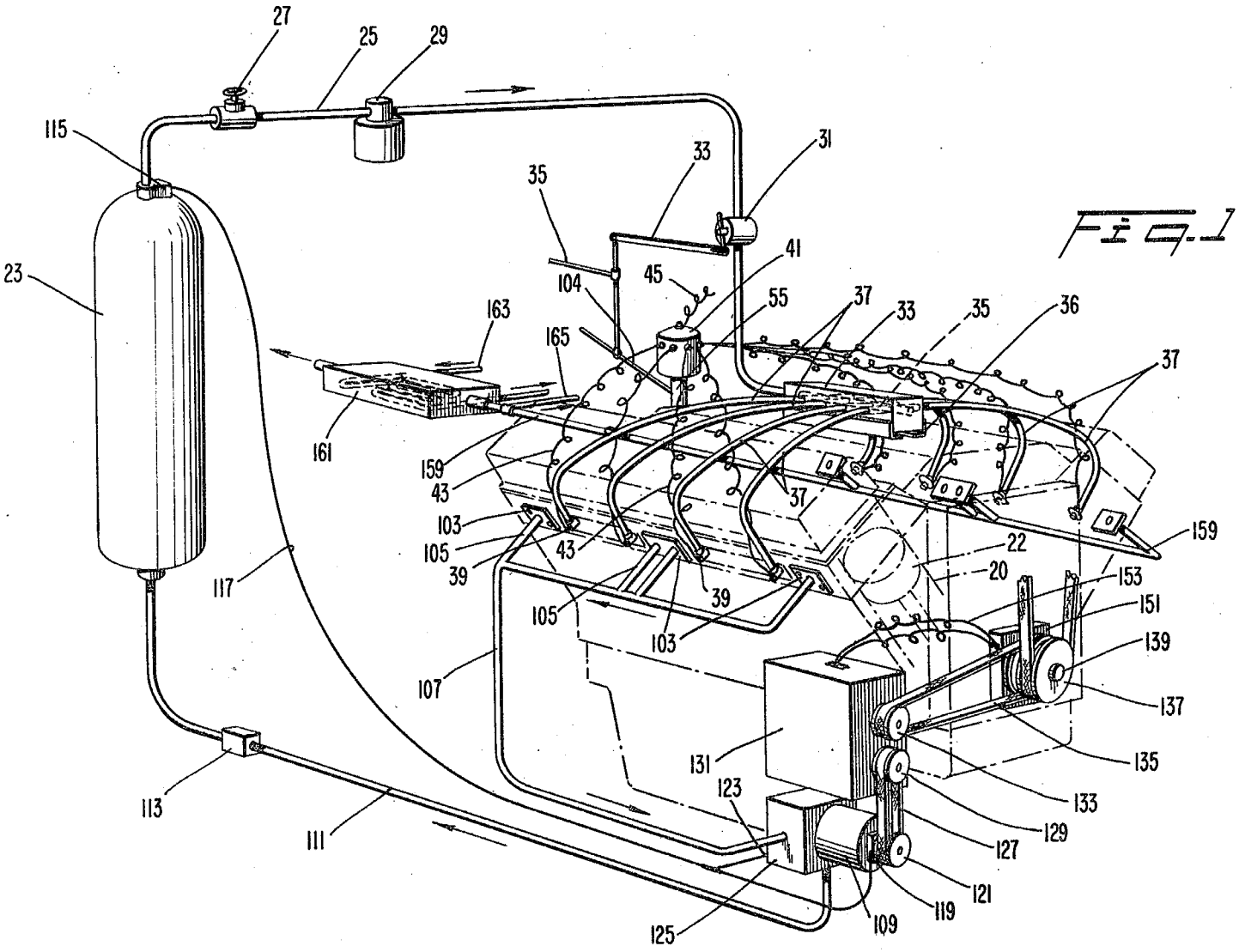
FIG. 1 is a schematic representation of an apparatus according to the present invention arranged on an engine.

With reference to FIG. 1, an engine block 21 (shown in phantom) having two banks of cylinders with each bank including cylinders 20 having pistons 22 reciprocable therein (only one of which is shown in phantom) in a conventional manner. While the illustrated engine is a V-8 engine, it will be apparent that the present invention is applicable to an engine having any number of pistons and cylinders with the V-8 engine being utilized for illustration purposes only. A compressed gas tank 23 is provided to store a compressed gas at high pressure. It may also be desirable to include a small electric or gas compressor to provide compressed gas to supplement the compressed gas held in the tank 23. In a preferred embodiment, the compressed gas is air which can be obtained from any suitable source.

A line 25 transports the gas withdrawn from the tank 23 when a conventional shut off valve 27 is open. In addition, a solenoid valve 29 preferably operated by a suitable key operated switch (not shown) for the engine is also arranged in the line 25. In normal operation, the valve 27 is maintained open at all times with the solenoid valve 29 operating as a selective shut off valve to start and stop the engine 21 of the present invention.

A suitable regulating valve 31 is arranged downstream from the solenoid valve 29 and is connected by a linkage 33 to a throttle linkage 35 which is operator actuated by any suitable apparatus such as a foot pedal (not shown). The line 25 enters an end of a distributor 33 and is connected to an end of a pipe 35 which is closed at the other end. A plurality of holes, which are equal to the number of cylinders in the engine 21, are provided on either side of the pipe 35 along the length of the pipe 35.

When the present invention is used to adapt a conventional internal combustion engine for operation on compressed gas, an adaptor plate 36 is provided to support the distributor 33 in spaced relation from the usual intake opening in the intake manifold of the engine after a conventional carburetor has been removed. In this way, air is permitted to enter the internal combustion engine through the usual passageways and to be admitted to the cylinders through suitable intake valves (not shown). The adaptor plate 36 is secured to the engine block 21 and the distributor 33 by any suitable apparatus, e.g., bolts.

Each of the holes in the pipe 35 is connected in fluid-tight manner to a single line 37. Each line 37 carries the compressed gas to a single cylinder 20. In a preferred embodiment, each of the lines 37 is ½ inch high pressure plastic tubing attached through suitable connectors to the distributor 33 and the pipe 35. Each of the lines 37 is connected to a valve 39 which is secured in an opening provided near the top of each of the cylinders 20. In the case of a conversion of a standard internal combustion engine, the valves 39 can be conveniently screwed into a tapped hole in the cylinder 20 typically provided for a spark plug of the internal combustion engine. In a preferred embodiment, the valves 39 are solenoid actuated valves in order to provide a fast and reliable opening and closing of the valves 39.

Each of the valves 39 is energized by a valve actuator 41 through one of a plurality of wires 43. The valve actuator 41 is driven by a shaft of the engine similar to the drive for a conventional distributor of an internal combustion engine. That is, a shaft 55 of the valve actuator 41 is driven in synchronism with the engine 21 at one half the speed of the engine 21.

A first embodiment of the valve actuator 41 (FIGS. 2 and 3) receives electrical power through a wire 45 which is energized in a suitable manner by a battery, and a coil if necessary (not shown) as is conventional in an internal combustion engine. The wire 45 is attached to a central post 47 by a nut 49. The post 47 is connected to a conducting plate 51 arranged within a housing 53 for the valve actuator 41. Within the housing 53, the shaft 55 has an insulating element 57 secured to an end of the shaft 55 for co-rotation therewith when the shaft 55 is driven by the engine 21. A first end of a flexible contact 59 is continuously biased against the conducting plate 51 to receive electricity from the battery or another suitable source. A second end of the contact 59 is connected to a conducting sleeve 60 which is in constant contact with a spring biased contact 61 which is arranged within the sleeve 60. The contact 61 is biased by a spring 63 which urges the contact 61 towards a side wall of the housing 53.

With reference to FIG. 3, a plurality of contacts 65 are spaced from one another and are arranged around the periphery of the housing 53 at the same level as the spring biased contact 61. Each contact 65 is electrically connected to a post 67 which extends outside of the housing 53. The number of contacts 65 is equal to the number of cylinders in the engine 21. One of the wires 43, which actuate the valves 39, is secured to each of the posts 67.

In operation, as the shaft 55 rotates in synchronism with the engine 21, the insulating element 57 rotates and electricity is ultimately delivered to successive ones of the contacts 65 and wires 43 through the spring biased contact 61 and the flexible contact 59. In this way, each of the electrical valves 39 is actuated and opened in the proper timed sequence to admit compressed gas to each of the cylinders 20 to drive the pistons 22 therein on a downward stroke.

The embodiment illustrated in FIGS. 2 and 3 is effective to actuate each of the valves 39 to remain open for a long enough period of time to admit sufficient compressed gas to each of the cylinders 20 of the engine 21 to drive the engine 21. The length of each of the contacts 65 around the periphery of the housing 53 is sufficient to permit the speed of the engine to be increased when desired by the operator by moving the throttle linkage 35 which actuates the linkage 33 to further open the regulating valve 31 to admit more compressed gas from the tank 23 to the distributor 33. However, it has been found that the amount of air admitted by the valves 39 when using the first embodiment of the valve actuator 41 (FIGS. 2 and 3) is substantially more than required to operate the engine 21 at an idling speed. Therefore, it may be desirable to provide a valve actuator 41 which is capable of varying the duration of each engine cycle over which the solenoid valves 39 are actuated, i.e., remain open to admit compressed gas, as the speed of the engine 21 is varied.

A second embodiment of a valve actuator 41 which is capable of varying the duration of each engine cycle over which each of the valves 39 remains open to admit compressed gas to the cylinders 20 dependent upon the speed of the engine 21 will be described with reference to FIGS. 4 and 5 wherein members corresponding to those of FIGS. 2 and 3 bear like reference numerals. The wire 45 from the electrical source is secured to the post 47 by the nut 49. The post 47 has a annular contact ring 69 electrically connected to an end of the post 47 and arranged within the housing 53. The shaft 55 rotates at one half the speed of the engine as in the embodiment of FIGS. 2 and 3.

At an upper end of the shaft 55, a splined section 71 slidably receives an insulating member 73. The splined section 71 of the shaft 55 positively holds the insulating member 73 for co-rotation therewith but permits the insulating member 73 to slide axially along the length of the splined section 71. Near the shaft 55, a conductive sleeve 72 is arranged in a bore 81 in an upper surface of the insulating element 73 generally parallel to the splined section 71. A contact 75, biased towards the annular contact ring 69 by a spring 77, is arranged within the conductive sleeve 72 in contact therewith. The conductive sleeve 72 also contacts a conductor 79 at a base of the bore 81.

The conductor 79 extends to the upper surface of the insulating element 73 near an outer periphery of the insulating element 73 where the conductor 79 is electrically connected to a flexible contact 83. The flexible contact 83 selectively engages a plurality of radial contacts 85 arranged on an upper inside surface of the housing 53. A weak spring 87 arranged around the splined section 71 engages a stop member 89 secured on the shaft 55 and the insulating element 73 to slightly bias the insulating element 73 towards the upper inside surface of the housing 53 to ensure contact between the flexible contact 83 and the upper inside surface of the housing 53. As best seen in FIG. 5, the radial contacts 85 on the upper inside surface of the housing 53 are arranged generally in the form of radial spokes extending from the center of the housing 53 with the number of contacts being equal to the number of cylinders 20 in the engine 21. The number of degrees covered by each of the radial contacts 85 gradually increases as the distance from the center of the upper inside surface of the housing 53 increases.

Figure 5:
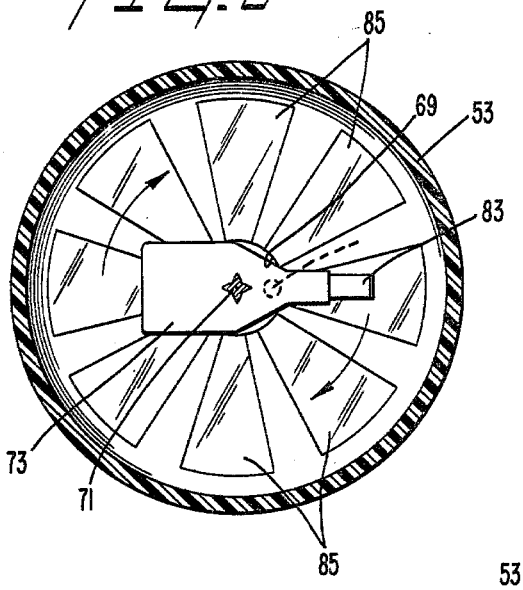
FIG. 5 is a view taken along the line 5—5 in FIG. 4.
Figure 4:
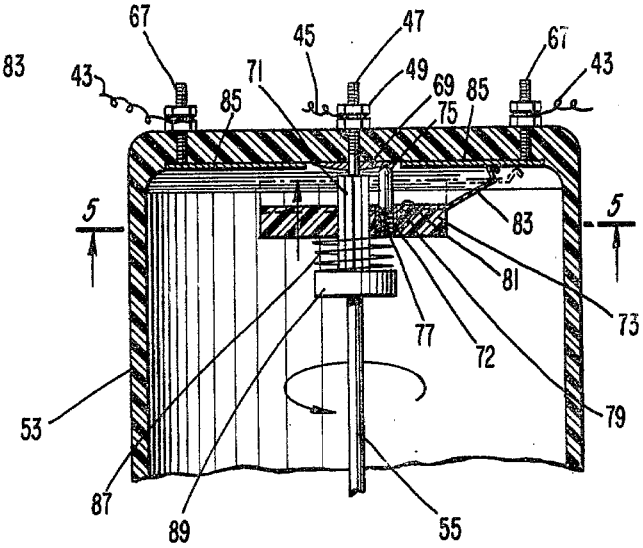
FIG. 4 is a cross-sectional view of a second embodiment of a valve actuator according to the present invention.

In operation of the device of FIGS. 4 and 5, as the shaft 55 rotates, electricity flows along a path through the wire 45 down through post 47 to the annular contact member 69 which is in constant contact with the spring biased contact 75. The electrical current passes through the conductive sleeve 72 to the conductor 79 and then to the flexible contact 83. As the flexible contact 83 rotates along with the insulating member 73 and the shaft 55, the tip of the flexible contact 83 successively engages each of the radial contacts 85 on the upper inside of the housing 53. As the speed of the shaft 55 increases, the insulating member 73 and the flexible contact 83 attached thereto move upwardly along the splined section 71 of the shaft 55 due to the radial component of the splines in the direction of rotation under the influence of centrifugal force. As the insulating member 73 moves upwardly, the flexible contact 83 is bent such that the tip of the contact 83 extends further radially outwardly from the center of the housing 53 (as seen in phantom lines in FIG. 4). In other words, the effective length of the flexible contact 83 increases as the speed of the engine 21 increases.

As the flexible contact 83 is bent and the tip of the contact 83 moves outwardly, the tip remains in contact with each of the radial contacts 85 for a longer period of each engine cycle due to the increased angular width of the radial contacts with increasing distance from the center of the housing 53. In this way, the length of time over which each of the valves 39 remains open is increased as the speed of the engine is increased. Thus, a larger quantity of compressed gas or air is injected into the cylinders as the speed increases. Conversely, as the speed decreases and the insulating member 73 moves downwardly along the splined section 71, a minimum quantity of air is injected into the cylinder due to the shorter length of the individual radial contact 85 which is in contact with the flexible contact 83. In this way, the amount of compressed gas that is used during idling of the engine 21 is at a minimum whereas the amount of compressed gas which is required to increase the speed of the engine 21 to a level suitable to drive a vehicle on a highway is readily available.

With reference to FIGS. 6 and 7, a third embodiment of a valve actuator 41 according to the present invention includes an arcuate insulating element 91 having a first end pivotally secured by any suitable device such as screw 92 to the shaft 55 for co-rotation with the shaft 55. The screw 92 is screwed into a tapped hole in the insulating element 91 such that a tab 94 at an end of the screw 92 engages a groove 96 provided in the shaft 55. In this way, the insulating element 91 positively rotates with the shaft 55. However, as the shaft 55 rotates faster, a second end 98 of the insulating element 91 is permitted to pivot outwardly under the influence of centrifugal force because of the groove 96 provided in the shaft 55. A spring 93 connected between the second end 98 of the element 91 and the shaft 55 urges the second end of the element 91 towards the center of the housing 53.

A contact 99 similar to the contact 59 (FIG. 2) is arranged such that one end of the contact 99 is in constant contact with the conducting plate 51 located centrally within the housing 53. The other end of the contact 99 engages a conductive sleeve 101 arranged in bore 102. A contact element 95 is arranged in the conductive sleeve 101 in constant contact with the sleeve 101. The bore 102 is arranged generally parallel to the shaft 55 near the second end of the arcuate insulating element 91. The contact 95 is biased by a spring 97 towards the upper inside surface of the housing 53 for selective contact with each of the plurality of radial contacts 85 which increase in arc length towards the outer peripheral surface of the housing 53 (FIG. 6).

In operation of the device of FIGS. 6 and 7, as the shaft 55 rotates the arcuate insulating element 91 rotates with the shaft 55 and the second end 98 of the insulating element 91 tends to pivot about the shaft 55 due to centrifugal force. Thus, as the effective length of the contact 95 increases, i.e., as the arcuate insulating element 91 pivots further outwardly, the number of degrees of rotation over which the contact 95 is in contact with each of the radial contacts 85 on the upper inside surface of the housing 53 increases thereby permitting each of the valves 39 to remain open for a longer period of each engine cycle to admit more compressed gas to the respective cylinder 20 to further increase the speed of the engine 21.

With reference to FIG. 1, a mechanical advance linkage 104 which is connected to the throttle linkage 35, advances the initiation of the opening of each valve 39 such that compressed gas is injected into the respective cylinder further before the piston 22 in the respective cylinder 20 reaches a top dead center position as the speed of the engine is increased by moving the throttle linkage 35. The advance linkage 104 is similar to a conventional standard mechanical advance employed on an internal combustion engine. In other words, the linkage 104 varies the relationship between the angular positions of a point on the shaft 55 and a point on the housing 53 containing the contacts. Alternatively, a conventional vacuum advance could also be employed. By advancing the timing of the opening of the valves 39, the speed of the engine can more easily be increased.

The operation of the engine cycle according to the present invention will now be described. The compressed gas injected into each cylinder of the engine 21 drives the respective piston 22 downward to drive a conventional crankshaft (not shown). The movement of the piston downwardly causes the compressed gas to expand rapidly and cool. As the piston 22 begins to move upwardly in the cylinder 20 a suitable exhaust valve (not shown) arranged to close an exhaust passageway is opened by any suitable apparatus. The expanded gas is then expelled through the exhaust passageway. As the piston 22 again begins to move downwardly a suitable intake valve opens to admit ambient air to the cylinder. The intake valve closes and the ambient air is compressed on the subsequent upward movement of the piston until the piston reaches approximately the top dead center position at which time the compressed gas is again injected into the cylinder 20 to drive the piston 22 downward and the cycle begins anew.

In the case of adapting a conventional internal combustion engine for operation on compressed gas, a plurality of plates 103 are preferably arranged over an end of the exhaust passageways in order to reduce the outlet size of the exhaust passageways of the conventional internal combustion engine. In the illustrated embodiment, a single plate having an opening in the center is bolted to the outside exhaust passageway on each bank of the V-8 engine while another single plate having two openings therein is arranged with one opening over each of the interior exhaust passageways on each bank of the V-8 engine. A line 105 is suitably attached to each of the adaptor places to carry the exhaust to an appropriate location. In a preferred embodiment, the exhaust lines 105 are 1½" plastic tubing.

In a preferred embodiment, the exhaust lines 105 of one bank of the V-8 engine are collected in a line 107 and fed to an inlet of a compressor 109. The pressure of the exhaust gas emmanating from the engine 21 according to the present invention is approximately 25 p.s.i. In this way, the compressor 109 does not have to pull the exhaust into the compressor since the gas exhausted from the engine 21 is at a positive pressure. The positive pressure of the incoming fluid increases the efficiency and reduces wear on the compressor 109. The exhaust gas is compressed in the compressor 109 and returned through a line 111 and a check valve 113 to the compressed gas storage tank 23. The check valve 113 prevents the flow of compressed gas stored in the tank 23 back towards the compressor 109.

A suitable pressure sensor 115 is arranged at an upper end of the tank 23 and sends a signal along a line 117 when the pressure exceeds a predetermined level and when the pressure drops below a predetermined level. The line 117 controls an electrically actuated clutch 119 disposed at a front end of the compressor 109. The clutch 119 is operative to engage and disengage the compressor 109 from a drive pulley 121. Also, the signal carried by the line 117 actuates a suitable valve 123 arranged on a compressor housing 125 to exhaust the air entering the compressor housing 125 from the line 107 when the clutch 119 has disengaged the compressor 109 from the drive pully 121.

In a preferred embodiment, when the pressure is the tank 23 reaches approximately 600 p.s.i., the clutch 119 is disengaged and the compressor 109 is deactivated and the valve 123 is opened to exhaust the expanded gas delivered to the compressor 109 from the line 107 to the atmosphere. When the pressure within the tank 23 drops below approximately 500 p.s.i., the sensor 115 sends a signal to engage the clutch 119 and close the valve 123, thereby operating the compressor 109 for supplying the tank 23 with compressed gas.

Figure 8:
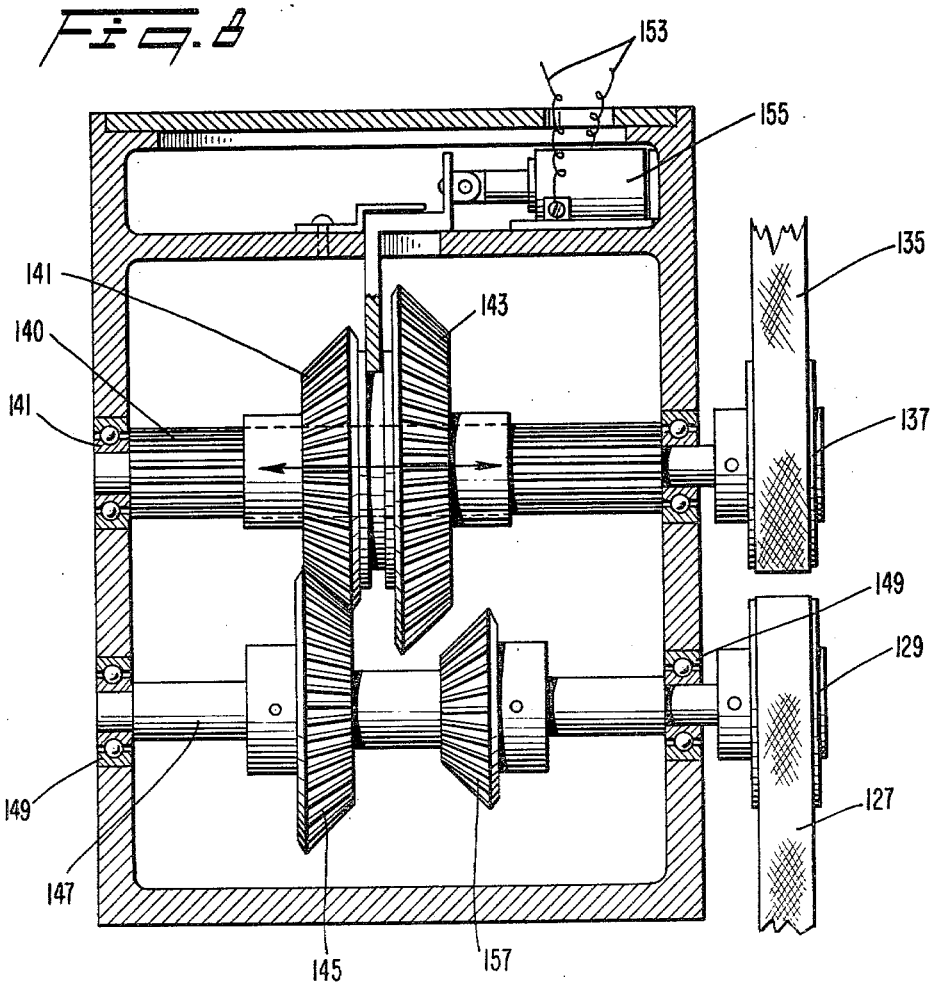
FIG. 8 is a cross-sectional view of a gearing unit to drive a compressor according to the present invention.

The pulley 121 which drives the compressor 109 through the clutch 119 is driven by a belt 127 which is driven by a pulley 129 which operates through a gear box 131. With reference to FIGS. 1 and 8, a second pulley 133 on the gear box is driven by a belt 135 from a pulley 137 arranged on a drive shaft 139 of the engine 21. The pulley 137 drives a splined shaft 140 which has a first gear 141 and a second larger gear 143 arranged thereon for rotation with the splined shaft 140. The splined shaft 140 permits axial movement of the gears 141 and 143 along the shaft 140.

In normal operation (as seen in FIG. 8), the first gear 141 engages a third gear 145 arranged on a shaft 147 which drives the pulley 129. The shafts 140 and 147 are arranged in suitable bearings 149 arranged at each end thereof. When the speed of the engine 21 drops below a predetermined level, a suitable sensor 151 responsive to the speed of the drive shaft 139 of the engine 21 generates a signal which is transmitted through a line 153 to a solenoid actuator 155 arranged within the gear box 131. The solenoid actuator 155 moves the first and second gears 141, 143 axially along the splined shaft 140 to the right as seen in FIG. 8 such that the second, larger gear 143 engages a fourth smaller gear 157 which is arranged on the shaft 147. The ratio of the second gear 143 to the fourth gear 157 is preferably approximately 3 to 1.

In this way, when the speed of the engine 21 drops below the predetermined level as sensed by the sensor 151 (which predetermined level is insufficient to drive the compressor 109 at a speed sufficient to generate the 500–600 pounds of pressure which is preferably in the tank 23), the solenoid actuator 155 is energized to slide the gears 143, 141 axially along the splined shaft 140 so that the second, larger gear 143 engages the fourth, smaller gear 157 to drive the pulley 129 and hence the compressor 109 at a higher rate of speed to generate the desired pressure. When the speed of the engine increases above the predetermined level, in a preferred embodiment approximately 1500 rpm, the solenoid actuator 155 is deactivated by the sensor 151 thereby moving the gears 143 and 141 to the left as seen in FIG. 8 such that the first gear 141 re-engages with the third gear 145 to effectuate a 1 to 1 ratio between the output shaft 139 of the engine 21 and the pulley 129.

The other bank of the V-8 engine has its exhaust ports arranged with adapter plates 103 similar to those on the first bank. However, the exhaust from this bank of the engine 21 is not collected and circulated through the compressor 109. In a preferred embodiment, a portion of the exhaust is collected in a line 159 and fed to an enlarged chamber 161. A second fluid is fed through a line 163 into the chamber 161 to be cooled by the cool exhaust emmanating from the engine 21 in the line 159. The second fluid in the line 163 may be either transmission fluid contained in a transmission associated with the engine 21 or a portion of the oil used to lubricate the engine 21. A second portion of the exhaust from the second bank of the V-8 engine is removed from the line 159 in a line 165 and used as a working fluid in an air conditioning system or for any other suitable use.

It should be noted that the particular arrangement utilized for collecting and distributing the gas exhausted from the engine 21 would be determined by the use for which the engine is employed. In other words, it may be advantageous to rearrange the exhaust tubing such that a larger or smaller percentage of the exhaust is routed through the compressor 109. It should also be noted that since the exhaust lines 105 are plastic tubing, a rearrangement of the lines for a different purpose is both simple and inexpensive.

In operation of the engine of the present invention, the engine 21 is started by energizing the solenoid valve 29 and any suitable starting device (not shown), e.g., a conventional electric starter as used on an internal combustion engine. Compressed gas from the full tank 23 flows through the line 25 and a variable amount of the compressed gas is admitted to the distributor 33 by controlling the regulator valve 31 through the linkage 33 and the operator actuated throttle linkage 35. The compressed gas is distributed to each of the lines 37 which lead to the individual cylinders 20. The compressed gas is admitted to each of the cylinders 20 in timed relationship to the position of the pistons within the cylinders by opening the valves 39 with the valve actuator 41.

When it is desired to increase the speed of the engine, the operator moves the throttle linkage 35 which simultaneously admits a larger quantity of compressed gas to the distributor 33 from the tank 23 by further opening the regulator valve 31. The timing of the valve actuator 41 is also advanced through the linkage 104. Still further, as the speed of the engine 21 increases, the effective length of the rotating contact 83 (FIG. 4) or 95 (FIG. 6) increases thereby electrically contacting a wider portion of one of the stationary radial contacts 85 to cause each of the valves 39 to remain open for a longer period of each engine cycle to admit a larger quantity of compressed gas to each of the cylinders 20.

As can be seen, the combination of the regulating valve 31, the mechanical advance 104, and the valve actuator 41, combine to produce a compressed gas engine which is quickly and efficiently adaptable to various operating speeds. However, all three of the controls need not be employed simultaneously. For example, the mechanical advance 104 could be utilized without the benefit of one of the varying valve actuators 41 but the high speed operation of the engine may not be as efficient. By increasing the duration of each engine cycle over which each of the valves 39 remains open to admit compressed gas to each of the cylinders 20 as the speed increases, conservation of compressed gas during low speed operation and efficient high speed operation are both possible.

After the compressed gas admitted to the cylinder 20 has forced the piston 22 downwardly within the cylinder to drive the shaft 139 of the engine, the piston 22 moves upwardly within the cylinder 20 and forces the expanded gas out through a suitable exhaust valve (not shown) through the adapter plate 103 (if employed) and into the exhaust line 105. The cool exhaust can then be collected in any suitable arrangement to be compressed and returned to the tank 23 or used for any desired purpose including use as a working fluid in an air conditioning system or as a coolant for oil.

When using the apparatus and method of the present invention to adapt a ordinary internal combustion engine for operation with compressed gas it can be seen that considerable savings in weight are achieved. For example, the ordinary cooling system including a radiator, fan, hoses, etc. can be eliminated since the compressed gas is cooled as it expands in the cylinder. In addition, there are no explosions within the cylinder to generate heat. Further reductions in weight are obtained by employing plastic tubing for the lines which carry the compressed gas between the distributor and the cylinders and for the exhaust lines. Once again, heavy tubing is not required since there is little or no heat generated by the engine of the present invention. In addition, the noise generated by an engine according to the present invention is considerably less than that generated by an ordinary internal combustion engine since there are no explosions taking place within the cylinders.

The principles of preferred embodiments of the present invention have been described in the foregoing specification. However, the invention which is intended to be protected is not to be construed as limited to the particular embodiments disclosed. The embodiments are to be regarded as illustrative rather than restrictive. Variations and changes may be made by others without departing from the spirit of the invention. Accordingly, it is expressly intended that all such variations and changes which fall within the spirit and the scope of the present invention as defined in the appended claims be embraced thereby.

What is claimed is:

1. An apparatus for operating an engine having at least one cylinder and a reciprocating piston therein comprising:

a source of compressed gas;

distributor means connected with the source of compressed gas for distributing the compressed gas to the at least one cylinder;

valve means for admitting the compressed gas to the at least one cylinder when the piston is in approximately a top dead center position within the cylinder;

altering means for increasing the duration of each engine cycle over which the valve means admits compressed gas to the at least one cylinder as the speed of the engine increases; and exhaust means for exhausting gas as the piston subsequently approaches approximately the top dead center position.

2. The apparatus of claim 1 further comprising control means for controlling the amount of compressed gas admitted to the distributor means.

3. The apparatus of claim 1 wherein the valve means is a solenoid valve secured in an opening in the cylinder above the level of the piston at the top dead center position.

4. The apparatus of claims 1 or 2 further comprising means for advancing the timing of the valve means as the speed of the engine increases such that compressed gas is admitted progressively further before the top dead center position as the speed of the engine increases.

5. The apparatus of claim 4 wherein the means for advancing the timing comprises a mechanical linkage connected to an operator actuated accelerator linkage.

6. The apparatus of claim 1 wherein a portion of the gas exhausted through the exhaust means is compressed in a compressor driven by an output shaft of the engine and is returned to the source of compressed gas.

7. The apparatus of claim 1 wherein a portion of the gas exhausted through the exhaust means is used to cool transmission fluid for a transmission associated with the engine.

8. The apparatus of claim 1 wherein a portion of the gas exhausted through the exhaust means is used as a working fluid in an air conditioning system.

9. The apparatus of claim 6 further comprising first gearing means interposed between the output shaft of the engine and the compressor for increasing the speed at which the compressor is driven.

10. The apparatus of claim 6 further comprising clutch means attached to the compressor both for disengaging the compressor from the output shaft of the engine when a first predetermined pressure at the source of compressed gas is exceeded and for engaging the compressor with the output shaft of the engine when the pressure at the source of compressed gas drops below a second predetermined pressure.

11. The apparatus of claim 9 further comprising means for both disengaging the first gearing means when a predetermined speed of the engine is exceeded and engaging a second gearing means for driving the compressor at a speed slower than the first gearing means when the predetermined speed of the engine is exceeded.

12. The apparatus of claim 1 wherein the valve means is electrically actuated and wherein the altering means comprises:

a rotating member timed with the at least one cylinder and arranged within a housing;

first and second contacts arranged on a first end of the rotating member and on an inside surface of the housing, respectively;

means for increasing the distance of the first contact from the rotational axis of the rotating member as the speed of the engine increases such that the first contact moves radially outwardly within the housing; and said second contact presenting a longer arc length to the first contact as the distance of the first contact from the rotational axis of the rotating member increases.

13. The apparatus of claim 12 wherein the rotating member comprises an arcuate arm and wherein the means for increasing the distance of the first contact comprises pivotally mounting a second end of the arcuate arm about the axis of rotation of the rotating member and spring means for biasing the first end of the arcuate arm towards a radially inward position whereby the first end of the arcuate arm pivots radially outwardly as the speed of the engine increases.

14. The apparatus of claim 12 wherein the rotating member is axially slidably received on a rotating shaft for co-rotation therewith, said shaft having splines with a radial component in the direction of rotation, and wherein the first contact comprises a flexible contact located on an upper surface of the rotating member, said flexible contact being biased against the inside surface of the housing which carries the second contacts whereby as the speed of the engine increases the rotating member is urged axially along the splined shaft towards the inside surface of the housing such that the flexible contact is forced radially outwardly along the inside surface.

15. The apparatus of claim 12 wherein the second contact comprises of radially extending conductor arranged on an upper inside surface of the housing, said conductor increasing in arc length as the conductor extends radially outwardly from a central portion of the housing.

16. An apparatus for adapting an internal combustion engine for operation with compressed gas, the internal combustion engine having at least one cylinder, a piston reciprocable within the at least one cylinder, intake and exhaust means disposed in the at least one cylinder, and a tapped hole in the at least one cylinder adapted to receive a spark plug, the apparatus comprising:

a source of compressed gas;

distributor means connected with the source of compressed gas for distributing the compressed gas to the at least one cylinder;

valve means arranged in the tapped hole for admitting the compressed gas to the at least one cylinder when the piston is in approximately a top dead center position within the cylinder; and altering means for increasing the duration of each engine cycle over which the valve means remains open to admit the compressed gas as the speed of the engine increases.

17. An apparatus as in claim 16 further comprising first adapter plate means for supporting the distributor means above an intake manifold of the engine, which adaptor plate means allows ambient air to enter through the intake manifold.

18. The apparatus of claim 16 further comprising second adapter plate means for reducing the exit area of the exhaust means.

19. A method of operating an engine on compressed gas, said engine having at least one cylinder and a piston reciprocable therein comprising the steps of:

delivering compressed gas from a source to a distributor;

distributing the compressed gas to the at least one cylinder;

admitting compressed gas to the at least one cylinder through an intake valve when the piston is at approximately a top dad center position;

increasing the duration of each engine cycle over which compressed gas is admitted to the at least one cylinder as the engine speed increases; and exhausting the remaining gas when the piston subsequently reaches approximately the top dead center position.

20. The method of claim 19 further comprising the step of controlling the amount of compressed gas which is delivered to the distributor.

21. The method of claim 19 further comprising the step of advancing the timing of the opening of the intake valve as the speed of the engine increases.

22. An apparatus for operating an engine having at least one cylinder and a piston reciprocable therein on compressed gas comprising:

a source of compressed gas;

distributor means connected with the source of compressed gas for distributing the compressed gas to the at least one cylinder;

electrically actuated valve means secured in an opening in the at least one cylinder for selectively admitting compressed gas to the at least one cylinder when the piston is in approximately a top dead center position; and means for advancing the timing of the valve means as the speed of the engine increases whereby compressed gas is admitted progressively further before the top dead center position as the speed of the engine increases.

* * * * *